US006578812B2

(12) United States Patent
Lemire

(10) Patent No.: US 6,578,812 B2
(45) Date of Patent: Jun. 17, 2003

(54) POSITIONING AND LOCKING HANGING SYSTEM

(76) Inventor: Robert Lemire, P.O. Box 299, Kings Park, NY (US) 11754

( * ) Notice: Subject to any disclaimer, the term of this patent is extended or adjusted under 35 U.S.C. 154(b) by 0 days.

(21) Appl. No.: 09/756,032

(22) Filed: Jan. 8, 2001

(65) Prior Publication Data

US 2002/0088917 A1 Jul. 11, 2002

(51) Int. Cl.[7] ..... A47G 1/16

(52) U.S. Cl. ..... 248/551; 248/466; 248/476; 248/489; 248/495; 248/475.1

(58) Field of Search ..... 248/466, 476, 248/489, 495, 475.1, 222.14, 551; 40/712, 713, 757, 761, 762, 745; 211/94.01

(56) References Cited

U.S. PATENT DOCUMENTS 1,363,321 A * 12/1920 Jaeger
4,611,779 A * 9/1986 Leonard, Jr. ..... 248/476
4,973,021 A * 11/1990 Schuite ..... 248/495
5,603,475 A * 2/1997 Lim ..... 248/222.14
5,806,826 A * 9/1998 Lemire ..... 248/476
5,931,439 A * 8/1999 Lemire ..... 248/493
5,961,090 A * 10/1999 Parkin ..... 248/475.1

* cited by examiner

*Primary Examiner*—Leslie A. Braun
*Assistant Examiner*—Ingrid Weinhold

(57) ABSTRACT

One or more horizontal brackets mounted to a surface provide support, positioning, and locking when one or more hanger bodies with adjustable hooks are attached to the back of a picture or other object so that the hooks grab onto the brackets. The brackets are beveled to provide space for the hooks between the surface and the bracket. The upward and downward facing hooks on the hangers move vertically along screws and hook onto the top and bottom of the horizontal brackets. The downward facing hooks that grab onto the top of the bracket provide support and horizontal positioning by sliding along the length of the bracket. They also position the picture to the desired height and make it level. The upward facing hooks that grab onto the bottom of the brackets lock the picture onto the brackets.

4 Claims, 6 Drawing Sheets

View A-A

POSITIONING AND LOCKING HANGING SYSTEM

FIELD OF THE INVENTION

The invention concerns a hanging system composed of one or more hanger bodies with one or more screws and adjustable hooks attached to a picture frame or other object, and one or more brackets that are attached onto a wall or surface. The system allows the object to be positioned while on the brackets and to lock the picture against the wall thereby providing a measure of security against theft and movement by incidental contact. The brackets are anchored into the wall so that there is space between the wall and the brackets for the interfacing attachments on the hanger. The system provides a measure of adjustability for position the picture on the wall without having to remove the object from the track.

BACKGROUND OF THE INVENTION

Known security picture hangers in commercial production used for hanging pictures onto walls are not able to adjust the position of the picture against the wall. They lack any significant capability for changing the position of the picture after the picture is attached to them without removing the picture. It is useful to be able to have a picture securely hung against a wall or other surface in the precise desired position without having to constantly remove the picture to make adjustments. The adjustability provided by this invention allows the picture to be moved to an infinite number of positions within a range without having to remove the picture from the wall and then to lock the picture at that position onto the wall. With one or more horizontal brackets along a length of a wall pictures can be added or removed from the brackets as desired. A security easel may even be the object attached to the brackets.

SUMMARY OF THE INVENTION

This invention combines one or more horizontal brackets attached to a wall and one or more hanger bodies attached to a picture or other object. Each hanger body has from one to three adjusting screws. Some embodiments have adjusting screws with hooks or bars that engage a bracket. Other embodiments have the hanger body and an adjusting screw engaging the bracket. This combination of components provides a system that supports the object on a wall or surface so that it can be precisely positioned over a range and then locked in that position.

The simplest embodiment is composed of a bracket in the form of a length of double beveled track anchored horizontally to the wall and a hanger body with a single screw and hook. The hanger body is attached to the top middle of the frame and has a downwardly inclined lower lip that fits onto the top of the track. This inclined lip fits into the space between the wall and the track and supports the picture that it is attached to. This connection also lets the picture move horizontally along the track. The single screw in the hanger body extends below the bottom of the track and the upwardly inclined threaded hook on the screw engages the bottom of the track. Tightening the hook onto the bottom of the track locks the picture in place.

A second embodiment has a horizontal track attached to a wall and a hanger body having two screws being attached to the top middle of a picture. The screws are positioned such that the first screw is on the outer edge of the hanger body and is threadedably engaged through the hanger body. The second screw is in the same plane as the first screw, closer to the base of the hanger and able to rotate freely. When the picture with the hanger attached is placed onto the track the outer screw engages the top recess of the track and supports the picture. The picture can then be positioned along the track to the desired horizontal position. The height of the picture can also be adjusted by raising or lowering this outer screw. The inner screw extends past the bottom of the track and the bottom hook travels up and engages the bottom side of the track when this screw is turned and this locks the picture in place.

The next embodiment is similar to the previous one except that it has two outer screws threaded in the hanger body on either side of the middle inner rotating screw. The two outer screws engage the top recess of the beveled track and provide leveling as well as horizontal and vertical positioning. The inner screw is again used to lock the picture by having the hook engage the bottom of the track.

The next embodiment has three screws horizontally along the same plane of the hanger body. The screws are free to rotate in the body and each screw has a threaded hook on it. The middle hook has an upwardly facing hook while the two outside screws have downward facing hooks. The two outside screws have retaining nuts where they exit the bottom of the hanger body to keep them from being pushed up through their respective holes in the hanger body. This assembly, when attached to the top back center of a picture, allows the picture to be hung with the two side hooks over the top of the track and the middle hook under the bottom of the track. This permits the picture to be leveled, positioned horizontally and vertically, and then locked onto the track.

Top and bottom hangers are used on the picture when security is desired. These embodiments require top and bottom tracks. For these embodiments the number of adjusting and locking screws and hooks in each hanger body can be reduced to a single middle hook. The bottom hook is facing in a downward direction and the top hook is facing in an upward direction. The bottom hook will go over the top of the bottom track while the top hook goes under the bottom of the top track. The bottom hook supports the picture onto the bottom track and the top hook holds the picture against the wall and forces the top of the picture into the bottom track when tightened.

The use of a single screw top and a single screw bottom hanger with two tracks permits horizontal and vertical positioning and locking onto the two track combination. The use of a double (side by side) screw for the bottom hanger permits leveling when used with two tracks. The use of a three screw hanger for the top and bottom hangers makes each track a supporting track.

For large pictures two top three screw hangers can be used near the top corners with a single long track or with two short tracks anchored to the wall. To have the top and bottom of the picture locked onto the wall a four corner arrangement with two long tracks or four short tracks can be used with four single screw hangers.

Instead of mounting the hangers onto the picture the hangers could be attached to an easel that has provisions for locking pictures onto itself. Two tracks would be used with four hangers attached to the corners of the easel for such an arrangement. The use of metal tracks would permit the addition of an electrical signal onto the tracks for monitoring and alarm devices on the easel.

DETAILED DESCRIPTION OF THE INVENTION

A locking picture hanging system that uses wall-mounted tracks and hanger bodies with one or more adjustable hooks attached to the pictures is the basis for this invention. The system allows the picture mounted on this system to be positioned and then to be locked in place on the track.

Figures 1A, 1B:
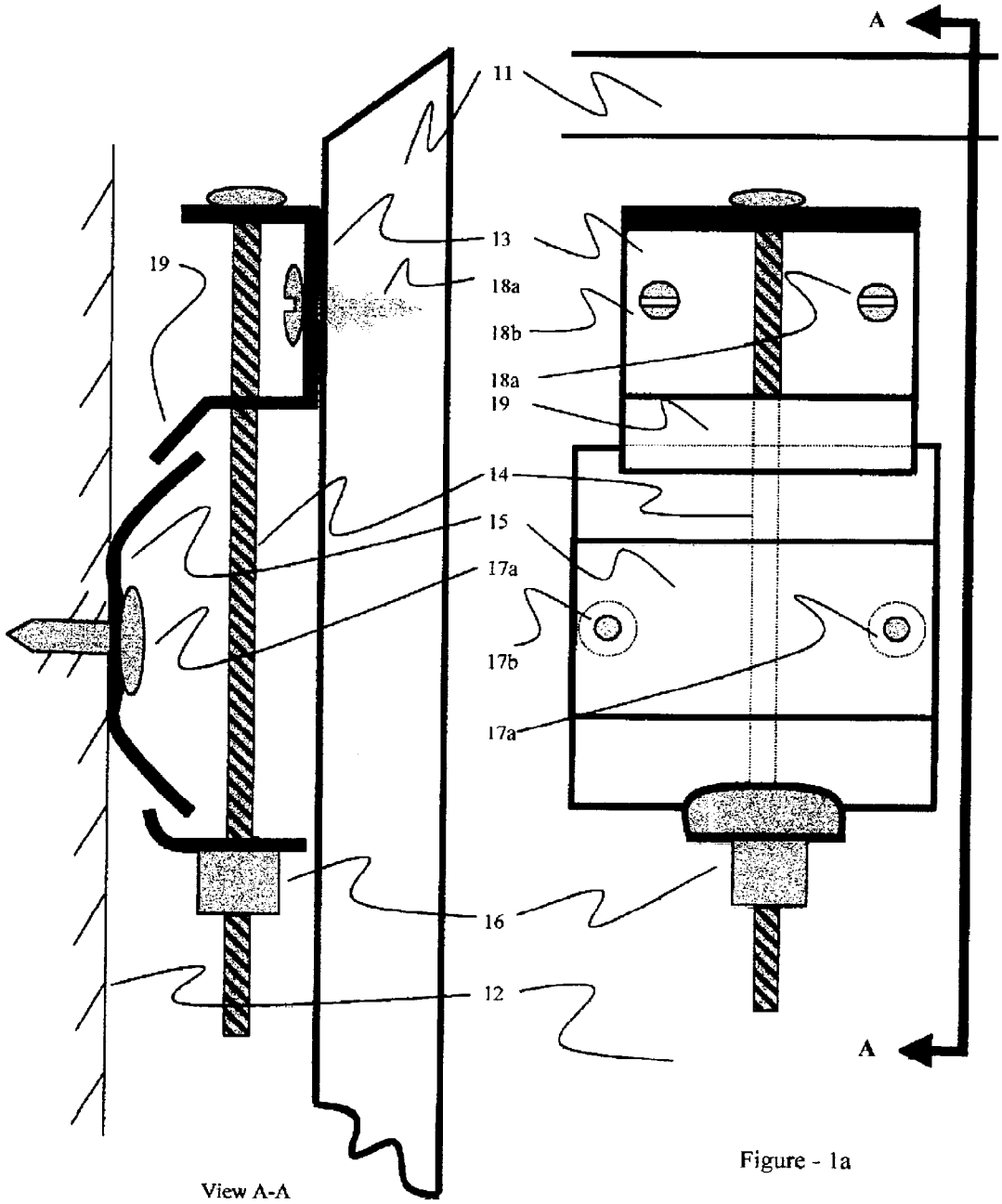
FIG. 1*a* is a back elevational view looking away from the wall with hanger body engaging the top of the beveled track and the threaded hook engaging the bottom of the beveled track.
FIG. 1*b* is a side elevational view of the device of FIG. 1*a*.

With reference to FIGS. 1*a* & 1*b*, in which like numerals represent like parts FIGS. 1*a* & 1*b* show hanger body 13 attached to picture frame 11 with screws 18*a* & 18*b*. The hanger body 13 has a downward extending lip 19 that sits on the top of the double beveled track 15 and allows horizontal positioning. The hanger body 13 has apertures to support and allow screw 14 to rotate freely. Screw 14 extends below the bottom of track 15 and has hook 16 threadably engaged on it. Hook 16 has an upward lip that engages and locks onto the bottom of track 15. Track 15 is attached to wall 12 with screws 17*a* & 17*b*. Picture 11 can be positioned horizontally along track 15 and then locked in place by tightening screw 14.

Figure 2:
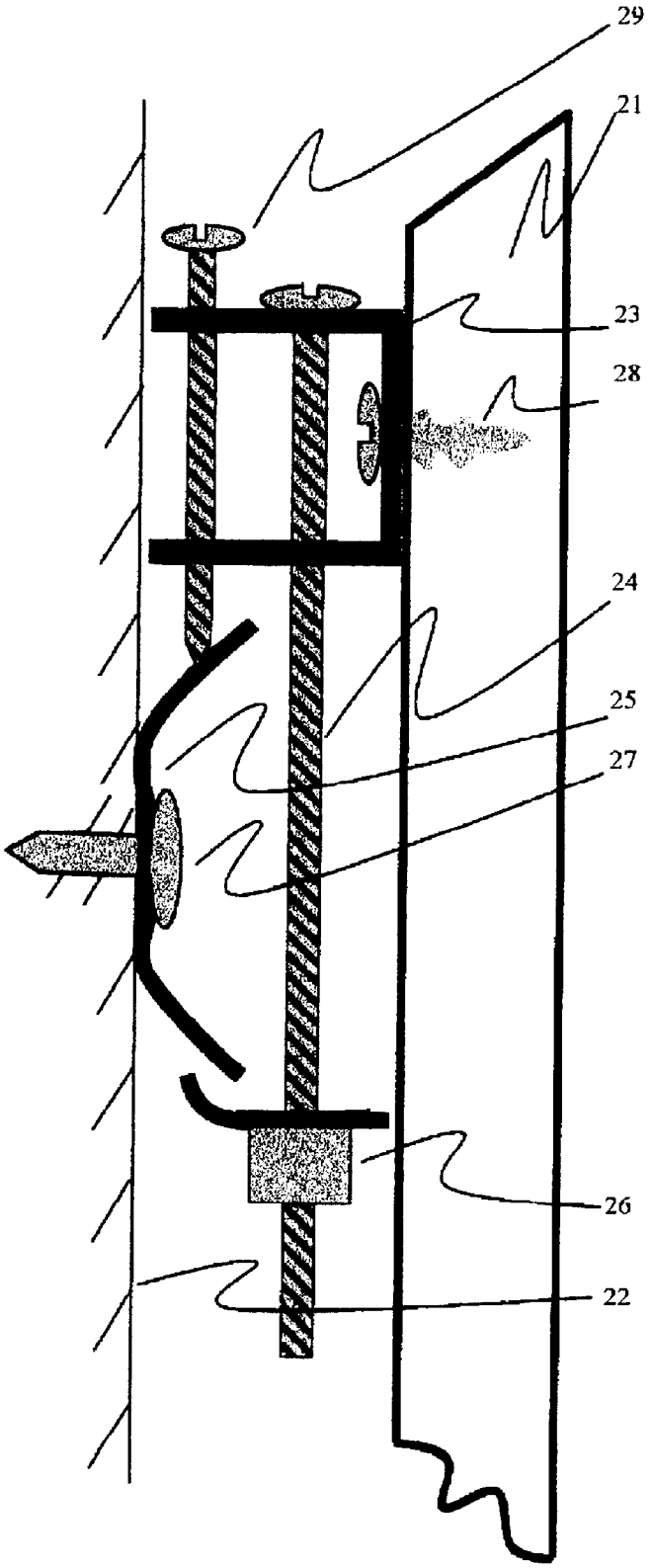
FIG. 2 is a side elevational view of the double screw hanger attached to the picture engaging the double beveled track anchored to the wall.

With reference to FIG. 2 the hanger body 23 is attached to picture frame 21 with screws 28. The hanger body 23 has an outer screw 29 threadably engaged and extending onto the top of the double beveled track 25 such that the vertical position of picture 21 can be changed by turning screw 29 and horizontal positioning is also possible. The hanger body 23 has inner apertures to support and allow screw 24 to rotate freely. Screw 24 extends below the bottom of track 25 and has hook 26 threadably engaged on it. Hook 26 has an upward lip that engages and locks onto the bottom of track 25. Track 25 is attached to wall 22 with screws 27. Picture 21 can be positioned vertically and horizontally along track 25 and then locked in place by tightening screw 24

Figure 3:
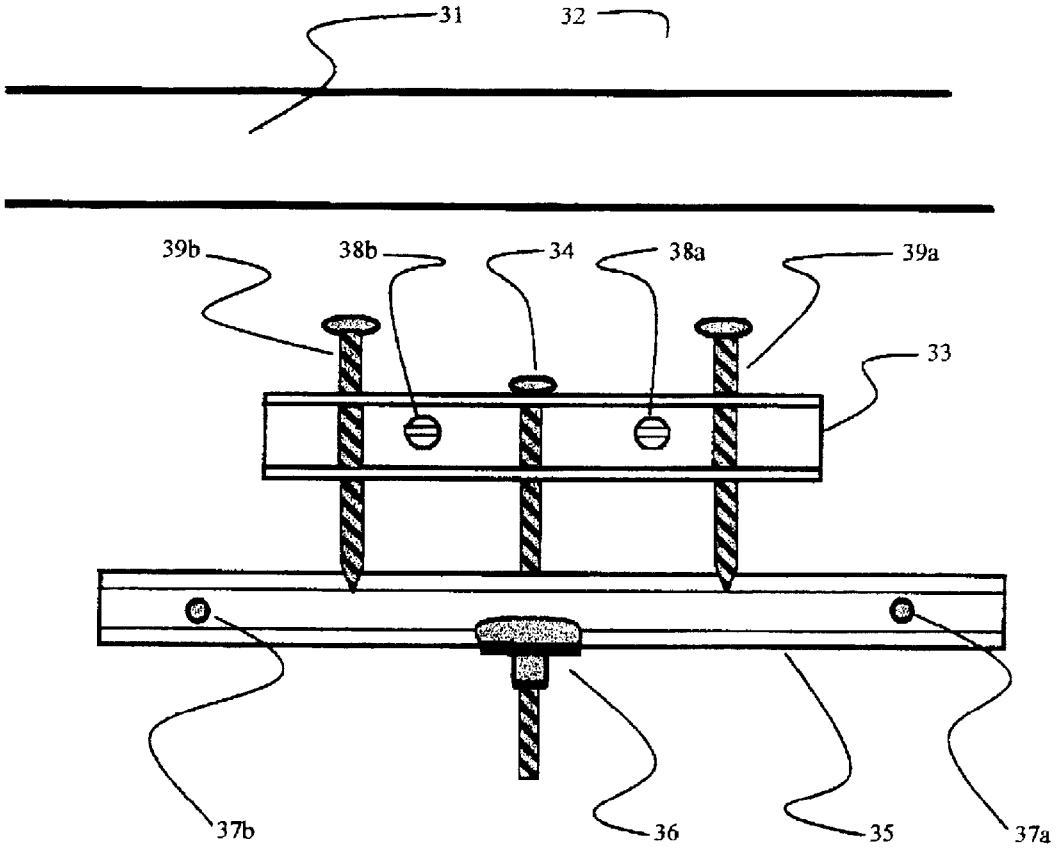
FIG. 3 is a back elevational view looking away from the wall with a three screw hanger body attached to picture and engaging a beveled track.

With reference to FIG. 3 the hanger body 33 attached to picture frame 31 with screws 38*a* & 38*b*. The hanger body 33 has two outer screws 39*a* & 39*b* threadably engaged and extending onto the top of the double beveled track 35 such that the vertical position, and levelness of picture 31 can be changed by turning screw 39*a* & 39*b*, and horizontal positioning is also possible. The hanger body 33 has inner apertures to support and allow screw 34 to rotate freely. Screw 34 extends below the bottom of track 35 and has hook 36 threadably engaged on it. Hook 36 has an upward lip that engages and locks onto the bottom of track 35. Track 35 is attached to wall 32 with screws 37*a* & 37*b*. Picture 31 can be positioned vertically and horizontally along track 35 and then locked in place by tightening screw 34.

Figure 4A:
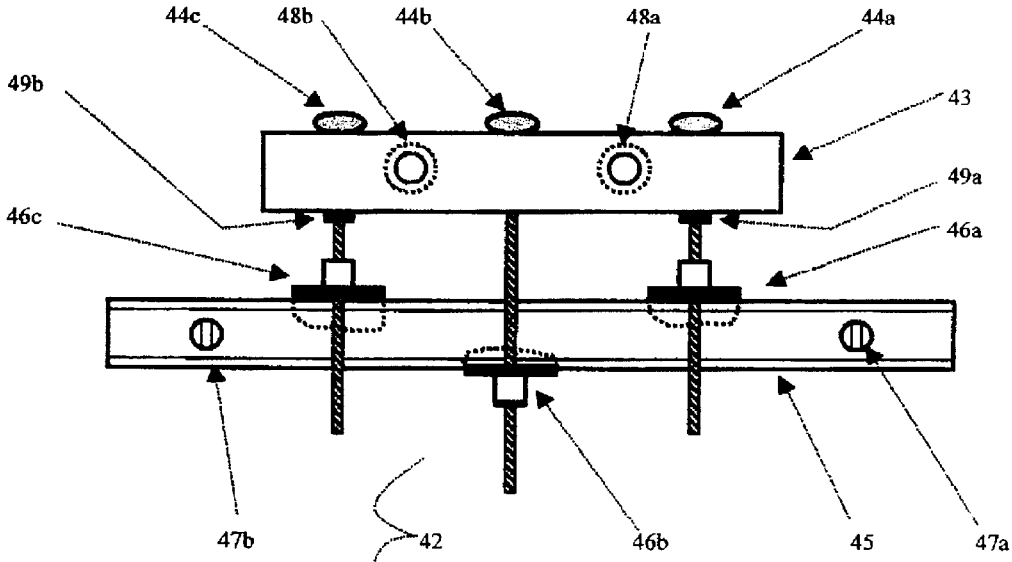
FIG. 4*a* is a back elevational view looking away from the back of the picture with a three screw hanger body attached to the back of the picture with the two outer hooks engaging the top of the beveled track, and the middle hook under the bottom of the track.
Figure 4B:
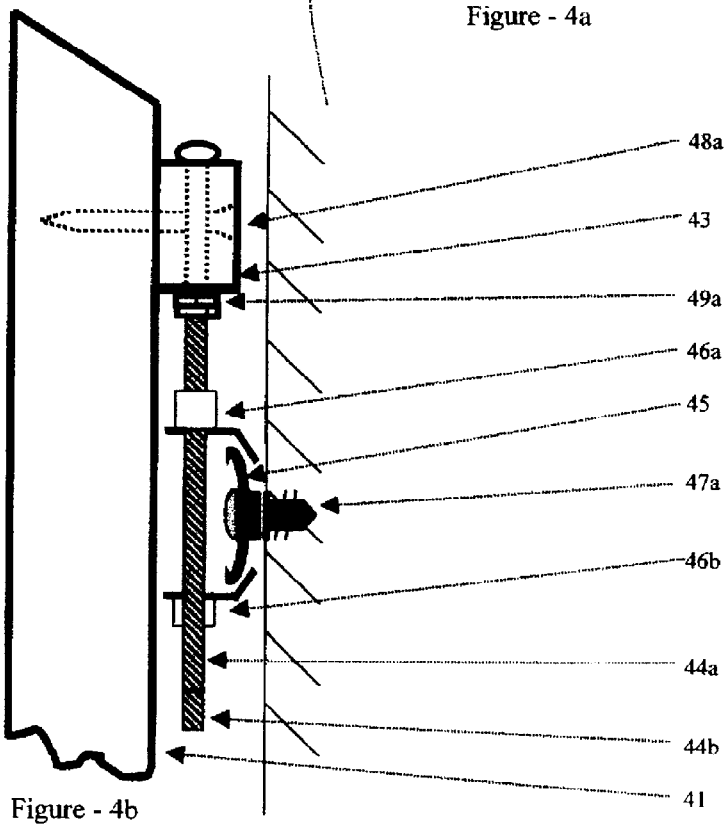
FIG. 4*b* is a side elevational view of the device of FIG. 4*a*.

With reference to FIGS. 4*a* & 4*b*, in which like numerals represent like parts, FIGS. 4*a* & 4*b* show the hanger body 43 attached to picture frame 41 with screws 48*a* & 48*b*. The hanger body 43 has apertures to support and allow screws 44*a*, 44*b*, & 44*c* to rotate freely. Screws 44*a* & 44*c* have lock-nuts 49*a* & 49*b* where they exit the bottom of hanger body 43 and downwardly facing hooks 46*a* & 46*c* threadably engaged on them. Hooks 46*a* & 46*c* go over track 45 and provide leveling, and vertical and horizontal positioning of picture frame 41. Screw 44*b* extends below the bottom of track 45 and has upward facing hook 46*b* threadably engaged on it. Hook 46*b* has an upward lip that engages and locks onto the bottom of track 45. Track 45 is attached to wall 42 with screws 47*a* & 47*b*. Picture 41 can be positioned vertically and horizontally along track 45 and then locked in place by tightening screw 44*b*.

Figure 5A:
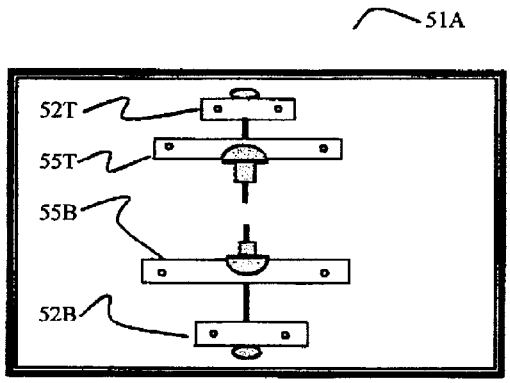
FIG. 5*a* is a back elevational view looking away from the back of the wall with top and bottom single screw hanger bodies attached to the back of the picture with the bottom hook engaging the top of the bottom beveled track, and the top hook under the bottom of the top track.

With reference to FIGS. 5*a*, 5*b*, 5*c*, 5*d*, & 5*e*, in which like numerals represent like parts, FIG. 5*a* shows the back of picture frame 51*a* with top and bottom single screw and hook hanger assemblies 52T & 52B engaging top and bottom tracks 55T & 55B. Hanger 52B supports and positions picture 51*a* on track 55B. Hanger 52T locks picture 51*a* onto the two tracks 55T & 55B.

Figure 5B:
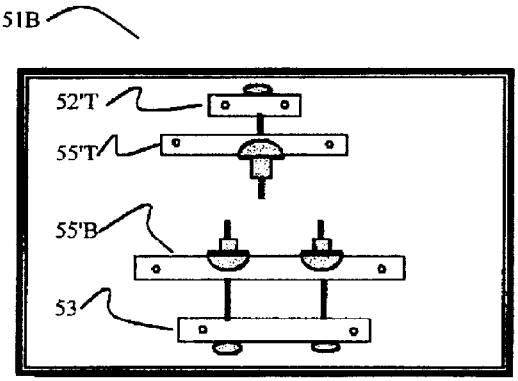
FIG. 5*b* is a back elevational view looking away from the back of the wall with a top single screw hanger body and a bottom double screw hanger body attached to the back of the picture with the two bottom books engaging the top of the bottom beveled track, and the top hook under the bottom of the top track.

FIG. 5*b* shows the back of picture frame 51*b* with a top single screw and hook hanger assembly 52'T engaging top track 55'T, and bottom double screw hanger 53 engaging track 55'B. Double screw hanger 53 supports, levels, and positions picture 51*b* on track 55'B. Single screw hanger 52'T locks picture 51*b* onto the two tracks 55'T & 55'B.

Figure 5C:
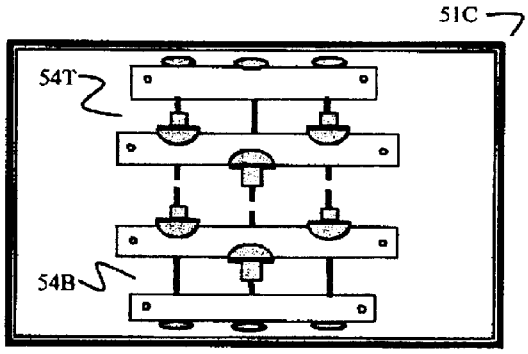
FIG. 5*c* is a back elevational view looking away from the back of the wall with top and bottom three screw hanger bodies attached to the back of the picture with the two outside bottom hooks engaging the top of the bottom beveled track, the middle bottom hook engaging the bottom of the track, and the two outside top hooks over the top of the top track, and the middle top hook under the bottom of the top track.

FIG. 5*c* shows the back of picture frame 51*c* with top and bottom triple screw and hook hanger assemblies and tracks 54T & 54B. Each hanger assembly and track supports, levels, positions, and locks picture 51*c* in place.

Figure 5D:
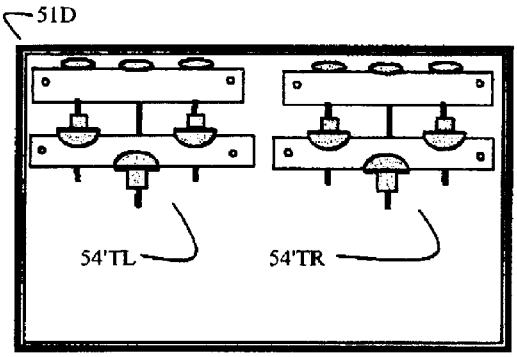
FIG. 5*d* is a back elevational view looking away from the back of the wall with two top three screw hanger bodies attached to the back of the picture with the two outside bottom hooks engaging the top of the left and right beveled tracks, and the middle hooks engaging the bottom of the right and left tracks.

FIG. 5*d* shows the back of picture frame 51*d* with right and left triple screw and hook hanger assemblies and tracks 54'TL & 54'TR. Each hanger assembly and track supports, levels, positions, and locks picture 51*c* in place.

Figure 5E:
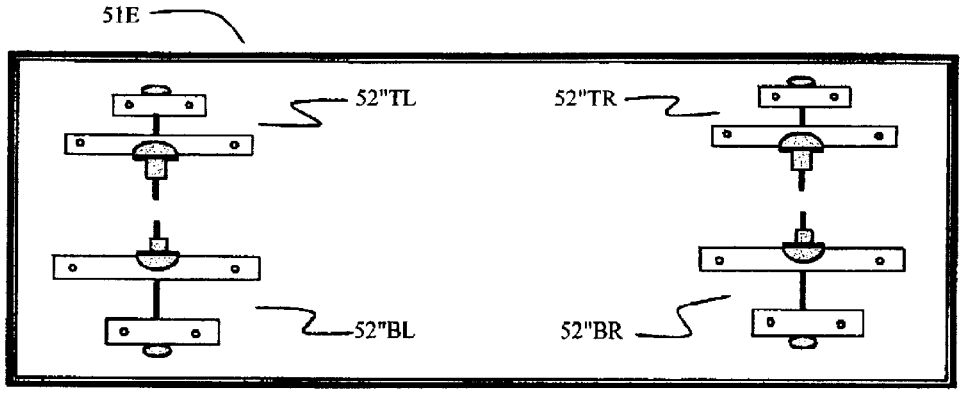
FIG. 5*e* is a back elevational view looking away from the back of the wall with four corner single screw hanger bodies attached to the back of the picture with the two bottom hooks engaging the top of the bottom beveled tracks, and the two top hooks engaging the bottom of the top beveled tracks.

FIG. 5*e* shows the back of picture frame 51E with single screw, hook and track hanger assemblies 52"TL, 52"TR,

52"BL & 52"BR on the four corners of picture frame 51E. These four hanger assemblies act to position and lock picture frame 51E in position.

Figure 6:
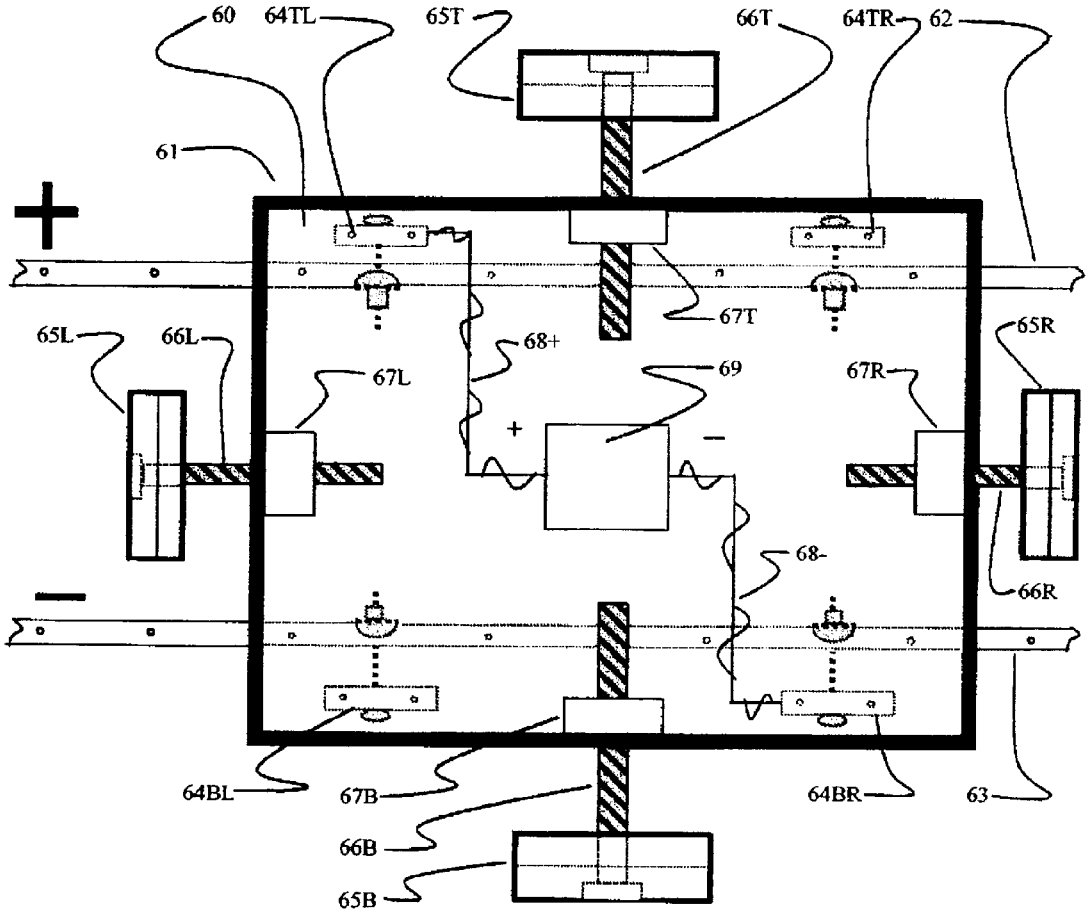
FIG. 6 is a front elevational view looking at a locking easel mounted onto two tracks with four single hook hangers attached to the back corners of the easel.

With reference to FIG. 6 tracks 62 & 63 are affixed to a wall such that single screw and hook hanger assemblies 64TL, 64TR, 64BL, & 64BR engage top and bottom tracks and are affixed to the four corners of easel body 60. Easel body 60 has top, bottom, and side picture frame holding brackets 65T, 65B, 65L, & 65R with heavy security screws 66T, 66B, 66L, & 66R engaging threaded connections 67T, 67B, 67L, & 67R affixed to the easel. The four picture frame holding brackets permit various size pictures to be held by the easel. The easel can be positioned and locked along the tracks with the hanger assemblies. The use of metal components for the tracks and hanger assemblies permits the addition of an electrical potential across the tracks such that wires 68+ & 68– may provide power for a monitoring and alarm system 69 mounted onto the easel 60.

While the invention has been described above with respect to certain embodiments thereof it will be appreciated that variations and modifications may be made without departing from the spirit and scope of the invention.

What is claimed is:

1. A bracket and hanger system composed of a horizontal bracket affixed to a surface, and a hanger body configured to be affixed to an object and having vertically adjustable hooks for engaging said bracket, whereby said object is supported, horizontally and vertically positionable, and lockable onto the bracket.

2. The system of claim 1 wherein the two outer screw hooks are facing down while the middle hook is facing up, such that the down facing hooks engage the top of the bracket and the middle hook engages the bottom of the bracket.

3. A bracket and hanger system composed of two or more horizontal brackets affixed to a surface, and two or more hanger bodies configured to be affixed to an object and having one or more vertically adjustable hooks for engaging said brackets, whereby said object is supported, horizontally and vertically positionable, and lockable onto the brackets.

4. The system of claim 3 wherein multiple metal brackets and hanger bodies are used to support an object holding device such that an electrical potential may be applied to the brackets for powering a monitoring and alarm device affixed to the object holding device, thereby allowing a wide variety of objects to be supported, positioned, locked, and monitored.

* * * * *